US005826802A

United States Patent [19]

Anderson et al.

[11] Patent Number: 5,826,802

[45] Date of Patent: Oct. 27, 1998

[54] DAMPED CHECK VALVE FOR FLUID INJECTOR SYSTEM

[75] Inventors: Michael D. Anderson, Metamora; Mark F. Sommars, Sparland, both of Ill.

[73] Assignee: Caterpillar Inc., Peoria, Ill.

[21] Appl. No.: 559,231

[22] Filed: Nov. 17, 1995

[51] Int. Cl.[6] ..... F02M 47/02

[52] U.S. Cl. ..... 239/533.8

[58] Field of Search ..... 239/533.2, 533.8, 239/533.9, 88, 96

[56] References Cited

U.S. PATENT DOCUMENTS

| | | | |
|---|---|---|---|
| 3,115,304 | 12/1963 | Humphries | 239/533.8 X |
| 3,610,529 | 10/1971 | Huber | 239/96 |
| 4,317,541 | 3/1982 | Beardmore | 239/88 |
| 4,403,740 | 9/1983 | Eblen et al. | 239/553.3 |
| 4,572,433 | 2/1986 | Deckard | 239/96 X |
| 4,624,135 | 11/1986 | Bungay et al. | 73/119 |
| 4,674,688 | 6/1987 | Kanesaka | 239/533.8 |
| 4,911,366 | 3/1990 | Priesner | 239/533.3 |
| 4,934,599 | 6/1990 | Hasagawa | 239/88 |
| 5,007,584 | 4/1991 | Rossignol | 239/88 |
| 5,165,607 | 11/1992 | Stevens | 239/533.4 |
| 5,241,935 | 9/1993 | Beck et al. | 123/300 |
| 5,441,029 | 8/1995 | Hlousek | 239/96 X |

FOREIGN PATENT DOCUMENTS

| | | |
|---|---|---|
| 0135872 | 4/1985 | European Pat. Off. . |
| 2295203 | 5/1996 | United Kingdom . |
| 80/02311 | 10/1980 | WIPO . |

*Primary Examiner*—Andres Kashnikow
*Assistant Examiner*—Steven J. Ganey
*Attorney, Agent, or Firm*—Michael B. McNeil; M. D. Becker

[57] ABSTRACT

An improved fuel injector system comprising a nozzle tip which defines a pressure control chamber, an injection chamber, and at least one fuel injection orifice. The nozzle tip further includes a movable direct-operated check operable to selectively control fluid communication between the injection chamber and the fuel injection orifice. The improvement includes a hilt reciprocally movable within the injection chamber and being of a construction to define a lower chamber and an upper chamber. The improvement further includes a high pressure fuel passage communicating high pressure fuel to the lower chamber. The present invention provides reduced stresses on the nozzle tip as the check engages the check seat while not adversely affecting the performance of the fuel injector. This results in lower tip wear and improved life of the fuel injector.

17 Claims, 5 Drawing Sheets

DAMPED CHECK VALVE FOR FLUID INJECTOR SYSTEM

TECHNICAL FIELD

The present invention relates generally to fluid injectors and more particularly to the check valve within the fuel injector nozzle.

BACKGROUND ART

Many electronically controlled fuel injectors utilize a pressure balanced check valve within the nozzle portion of the fuel injector. The pressure on the top side of the check valve controls the opening and closing of the check. This type of check valve is particularly useful in today's injectors in order to provide very rapid check closure and sharp fuel shutoff to minimize emissions. However, the rapid closure has the disadvantage of increasing check closure velocity resulting in higher impact forces acting on the tip of the fuel injector. This disadvantage has been evidenced by increased tip wear in the area around the injection orifices.

What was needed was a check valve which provided the check response in both the opening and closing directions to satisfy today's strict emission requirements, but reduced the tip impact stress to an acceptable level. The present invention is directed to overcoming one or more of the problems as set forth above.

DISCLOSURE OF THE INVENTION

In one aspect of the present invention, a fuel injector nozzle is disclosed which includes a check stop, a check sleeve, and a nozzle tip. The nozzle tip defines a pressure control chamber, an injection chamber, and at least one fuel injection orifice. A movable direct-operated check is disposed within said nozzle tip and is operable to selectively engage a check seat to control fluid communication between the injection chamber and the fuel injection orifice. A pressure control valve is included to control the movement of the check. The improved fuel injector nozzle results from the check having a hilt disposed within the injection chamber and being of a construction suitable to divide the injection chamber into a lower and an upper hilt chamber. The improvement further includes a high pressure fuel passage communicating high pressure fuel to the lower hilt chamber. This allows for a reduction in the stress on the check seat when the check engages the check seat.

In another aspect of the present invention, a fuel injector includes an injector housing which encloses a check stop, a check sleeve, and a nozzle tip. The tip defines a pressure control chamber, an injection chamber, and at least one fuel injection orifice. An injecting means is disposed within the nozzle tip for selectively controlling fluid communication between the injection chamber and the fuel injection orifice. A controlling means is disposed within the housing for controlling the actuation of said injecting means and a restriction means is disposed within said nozzle tip for damping the movement of said injecting means.

The present invention provides reduced stresses on the nozzle tip while not adversely affecting the performance of the fuel injector. This results in lower tip wear and improved life of the fuel injector.

BEST MODE FOR CARRYING OUT THE INVENTION

Figure 1:
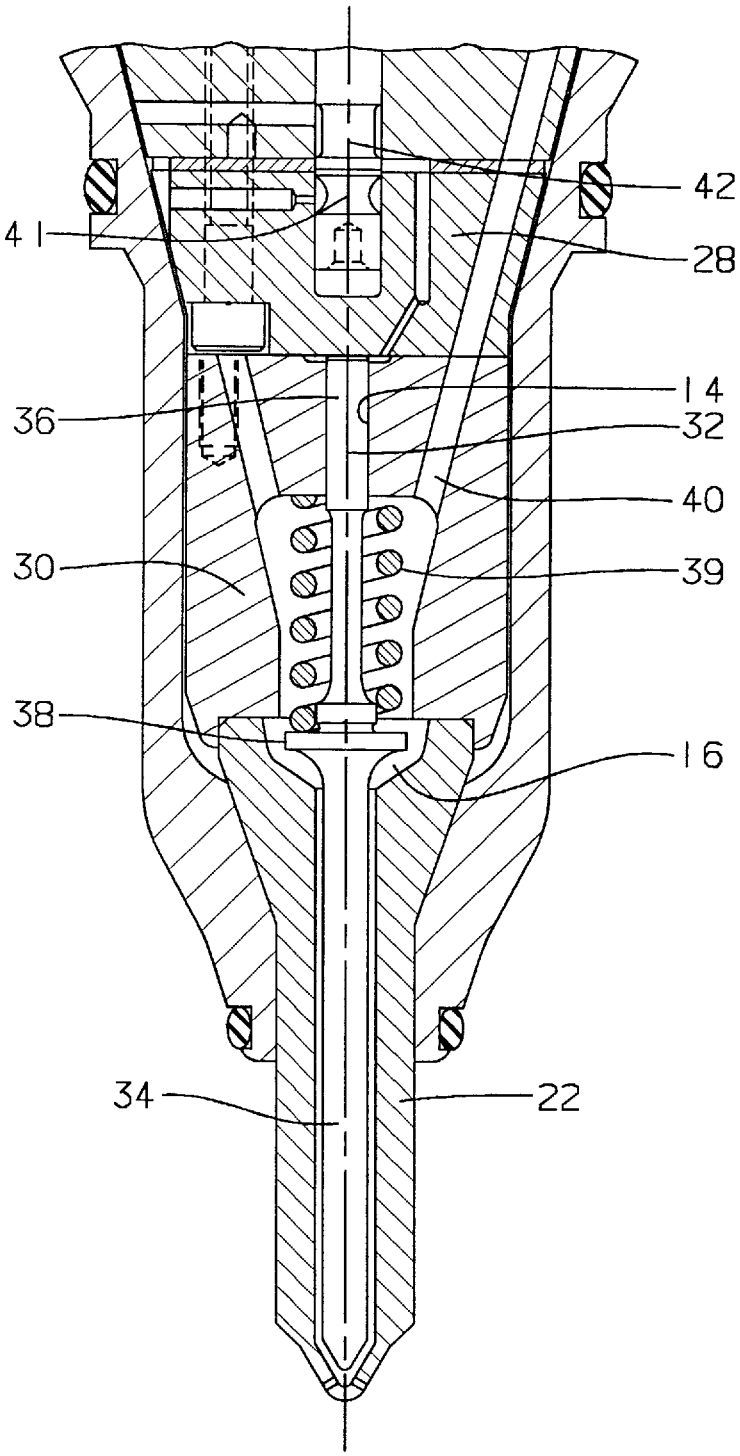
FIG. 1 is a diagrammatic partial cross-sectional view of the lower portion of an electronically-controlled fuel injector with a prior art nozzle check valve.
Figure 2:
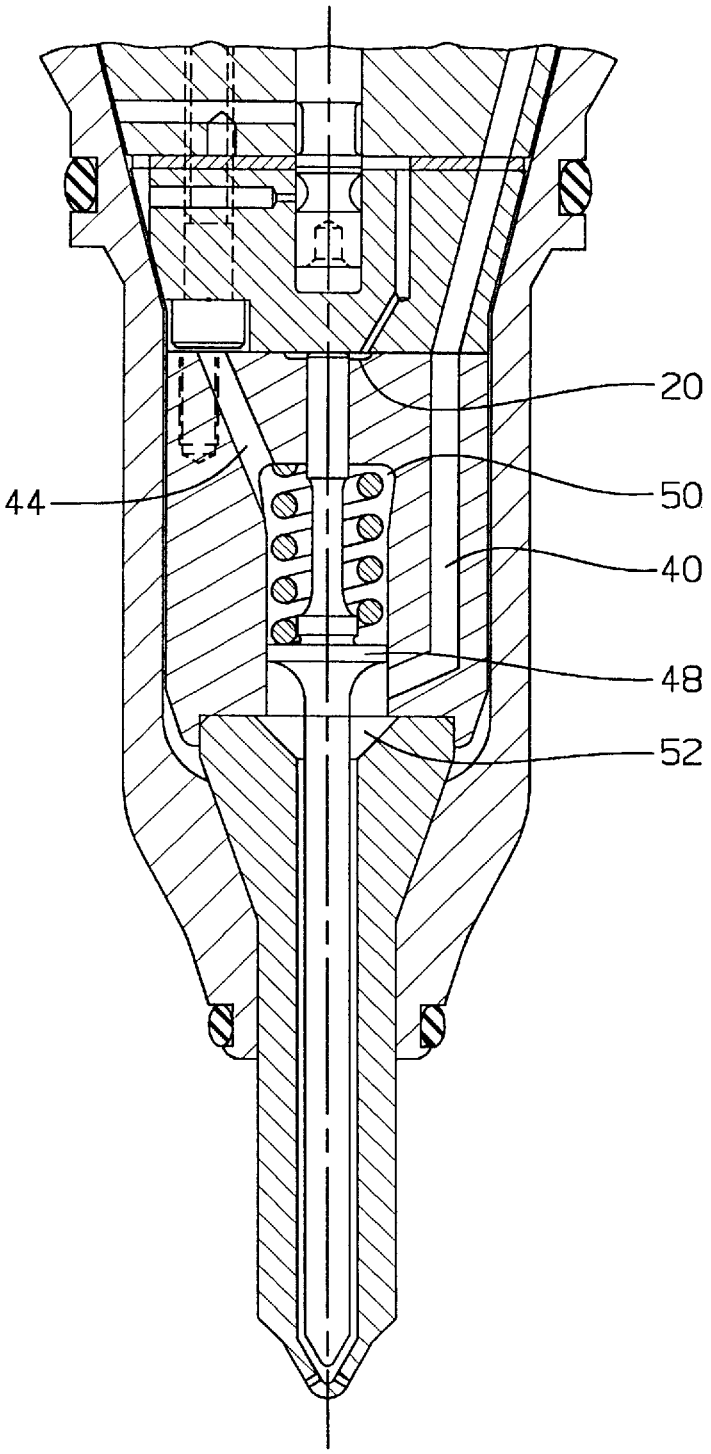
FIG. 2 is a diagrammatic partial cross-sectional view of the lower portion of a fuel injector showing one embodiment of the present invention nozzle check valve.

Referring to FIGS. 1 and 2, wherein similar reference numerals designate similar elements or features throughout the Figures, there is shown an embodiment of a fuel injection system 10 of the present invention. The exemplary fuel system 10 is shown in FIGS. 1–2 as adapted for a electronically-controlled unit injector; however, it should be understood that the present invention is also applicable to other types of fuel injectors such as hydraulically-actuated electronically-controlled unit injectors or mechanically actuated fuel injectors.

Referring now to FIG. 1, pressure balanced fuel injector check valves have long been known in the art. These fuel injectors include a nozzle portion 12 which has a bore 14, an injection chamber 16 integral with or arranged in fluid communication with a storage chamber 18 (not shown), a pressure control chamber 20 separate from the injection chamber 16 and the storage chamber 18, a tip 22 which defines a tip seat 24, and at least one fuel injection orifice 26. The nozzle portion also includes a check stop 28 positioned above the pressure control chamber 20 and a check sleeve 30 positioned between the check stop 28 and the tip 22.

An injecting means is preferably positioned in the bore 14 of the nozzle portion 12 and selectively movable between a first position blocking fluid communication between the injection chamber 16 and the fuel injection orifice 26 and a second position opening fluid communication between the injection chamber 16 and the fuel injection orifice 26. The injecting means is preferably a check valve 32. The check 32 has a first end portion 34 and a second end portion 36. The first end portion 34 defines a first effective area arranged in partial fluid communication with the injection chamber 16 when the check 32 is closed (i.e., its first position). The first effective area is arranged to be in complete fluid communication with the injection chamber 16 when the check 32 is opened (i.e., its second position), when the check 32 is spaced apart from the tip seat 24. The second end portion 36 defines a second effective area arranged in fluid communication with the pressure control chamber 20. The check 32 includes a hilt 38 positioned between the check first and second end portions, 34 and 36 respectively and reciprocally disposed within the injection chamber 16.

A first biasing device 39, preferably a first mechanical spring, is included within the injection chamber 16. The first biasing device 39 acts against the hilt 38 and the check sleeve 30 to bias the check 32 towards its closed or first position. The check second end portion 36 reciprocates in the bore 14 with a tight pre-selected clearance.

A high pressure fuel passage 40 is included through the check stop 28 and check sleeve 30 and communicates high pressure fuel between the storage chamber 18 and the injection chamber 16.

A controlling means 41 is selectively movable between a de-energized first position and an energized second position. Preferably, the controlling means 41 is a three-way valve 42 such as a poppet valve or spool valve. The valve 42 at its first position blocks fluid communication between the pressure control chamber 20 and the control passage 44 and opens fluid communication between the pressure control chamber 20 and the injection chamber 16. The valve 42 at its second position opens fluid communication between the pressure control chamber 20 and the fuel control passage 44 and blocks fluid communication between the pressure control chamber 20 and the injection chamber 16. When the check 32 is closed and the valve 42 is at its second position, the first and second effective areas are operable for hydraulically moving the check 32 towards its second (opened) position. When the check 32 is at its second (opened) position and the valve 42 is at its first position, the first and second effective areas are operable for balancing opposing hydraulic forces acting on such effective areas thereby allowing the first biasing device 38 to move the check 32 towards its first (closed) position. A second biasing device biases the valve 42 towards its first position.

FIG. 2 shows a fuel injector check valve which is substantially identical to the check valve previously described except that a restriction means 47 is positioned between the first and second end portions of the check 32. Preferably the restriction means 47 is a hilt 48 which reciprocates within the injection chamber 16 with a tight fit diametral clearance with the check sleeve 30. The tight fit of the hilt 48 within the check sleeve acts to divide the injection chamber 16 into an upper hilt chamber 50 and a lower hilt chamber 52. In addition, the high pressure fuel passage 40 communicates high pressure fuel between the pressurization chamber 18 and the lower hilt chamber 52, rather than into the upper portion of the injection chamber.

Industrial Applicability

The restriction means 47 provides damping for the check 32 as the check moves in both the closing and the opening directions. When the check 32 is moving from its closed to its open position, the upper hilt chamber 50 volume is compressed which acts to raise the pressure. At the same time, the lower hilt chamber 52 is expanded causing a reduction in pressure below the hilt 48. The pressure delta between the upper and lower hilt chambers acts upon the hilt 48 to oppose the opening of the check 32.

When the check 32 is moving from is open position towards its closed position, the situation is reversed. The compression of the lower hilt chamber 52 causes a pressure increase and the expansion of the upper chamber 48 causes a reduction in pressure. The overall result is a net upward force which acts to reduce the check velocity and the check impact force.

The check 32 is pressure balanced such that the pressure control chamber 20 controls the opening and closing of the check 32. In operation, before an injection cycle begins, the valve 42 is de-energized so that the valve 42 is at its first position. The check 32 is at its first (closed) position. The fuel storage chamber 18 and the injection chamber 16 are filled with relatively low pressure fuel and the pressure control chamber 20 is in fluid communication with the injection chamber 16.

As the fuel pressure within the fuel storage chamber increases, the second effective area exposed to high fuel pressure is greater than the first effective area exposed to high fuel pressure thereby preventing the check 32 from opening.

To start injection, the valve 42 is energized thereby moving the valve 42 to its second position. This allows for communication between the pressure control chamber 20 with the fuel control pressure passage 44. This acts to reduce the pressure in the pressure control chamber 20 while maintaining high pressure in the injection chamber 16, so that the check 32 opens to begin fuel injection through the injection orifice(s) 26 and into the engine combustion chamber (not shown).

To end fuel injection, the valve 42 is de-energized, moving the valve 42 back to its first position blocking fluid communication between the pressure control chamber 20 and the fuel control pressure passage 44. Moreover, fluid communication is opened between the pressure control chamber 20 and the injection chamber 16 thereby introducing high pressure fuel back into the pressure control chamber 20.

Preferably, the first and second effective areas of the check 32 are sized such that when the check 32 is opened and the valve 42 is at its first position, the net hydraulic forces acting on the check 32 are effectively zero and the force of the first biasing spring 39 is preferably the only unbalanced force acting on the check 32, biasing the check 32 toward its first (closed) position. At the end of a fuel injection cycle or injection segment, when the valve 42 has returned to its first position, the force of the first spring 34 urges the check 32 from its opened position to its closed position. The first spring force is preferably chosen to be sufficiently high for adequate check response yet sufficiently low to gently move the check 32 toward the tip seat 24 so that the check 32 does not over stress the tip 22 upon initial contact. However, this is a difficult balance to strike. The present invention provides for the use of the fuel pressure within the upper and lower hilt chambers, 50 and 52 respectively, to act as a fluid damper to the movement of the check 32.

Figure 3:
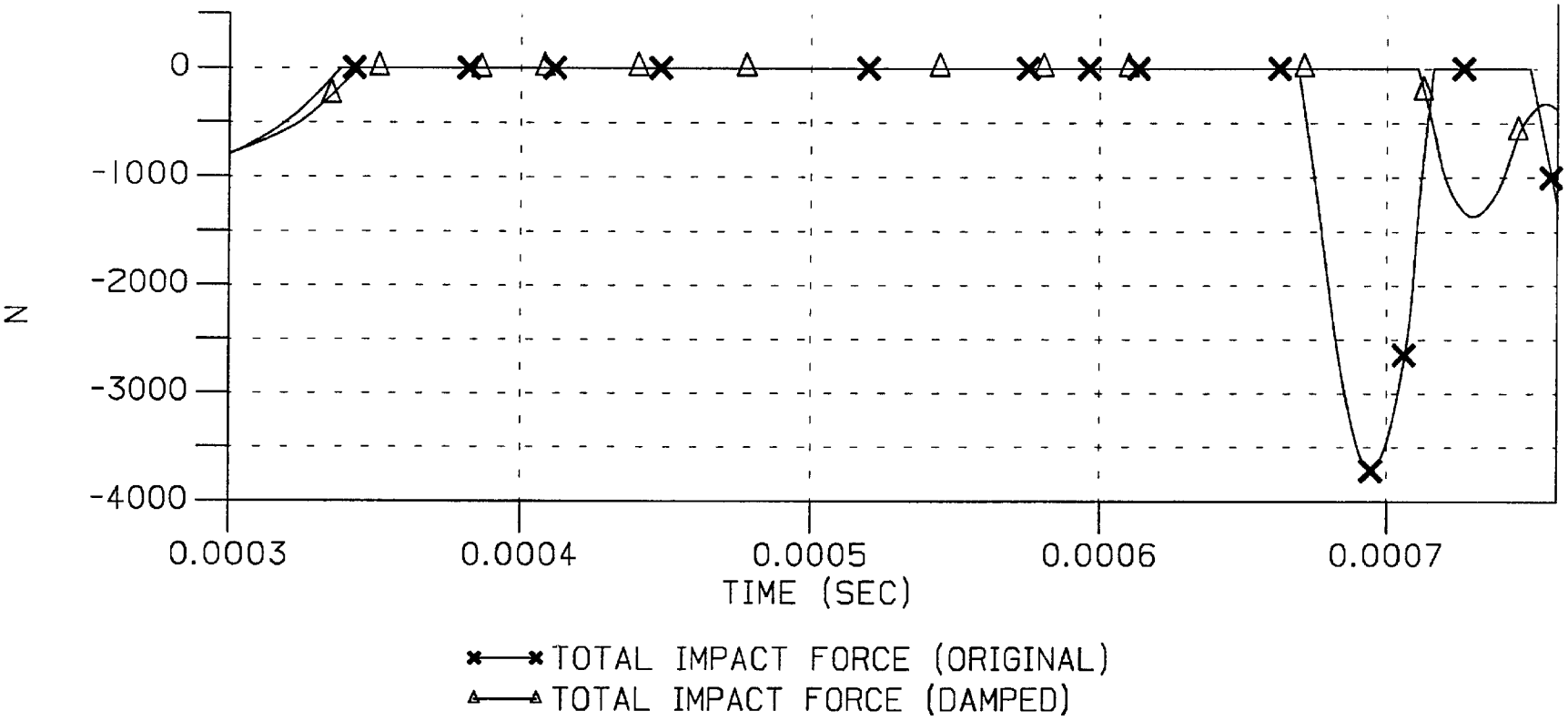
FIG. 3 is a diagrammatic approximate graph of check total impact force, F measured in Newtons versus time, T measured in seconds, comparing predicted operation of a computer-simulated exemplary injector of the prior art conventional electronically-controlled injector check valve of FIG. 1 versus the present invention injector check valve of FIG. 2.
Figure 4:
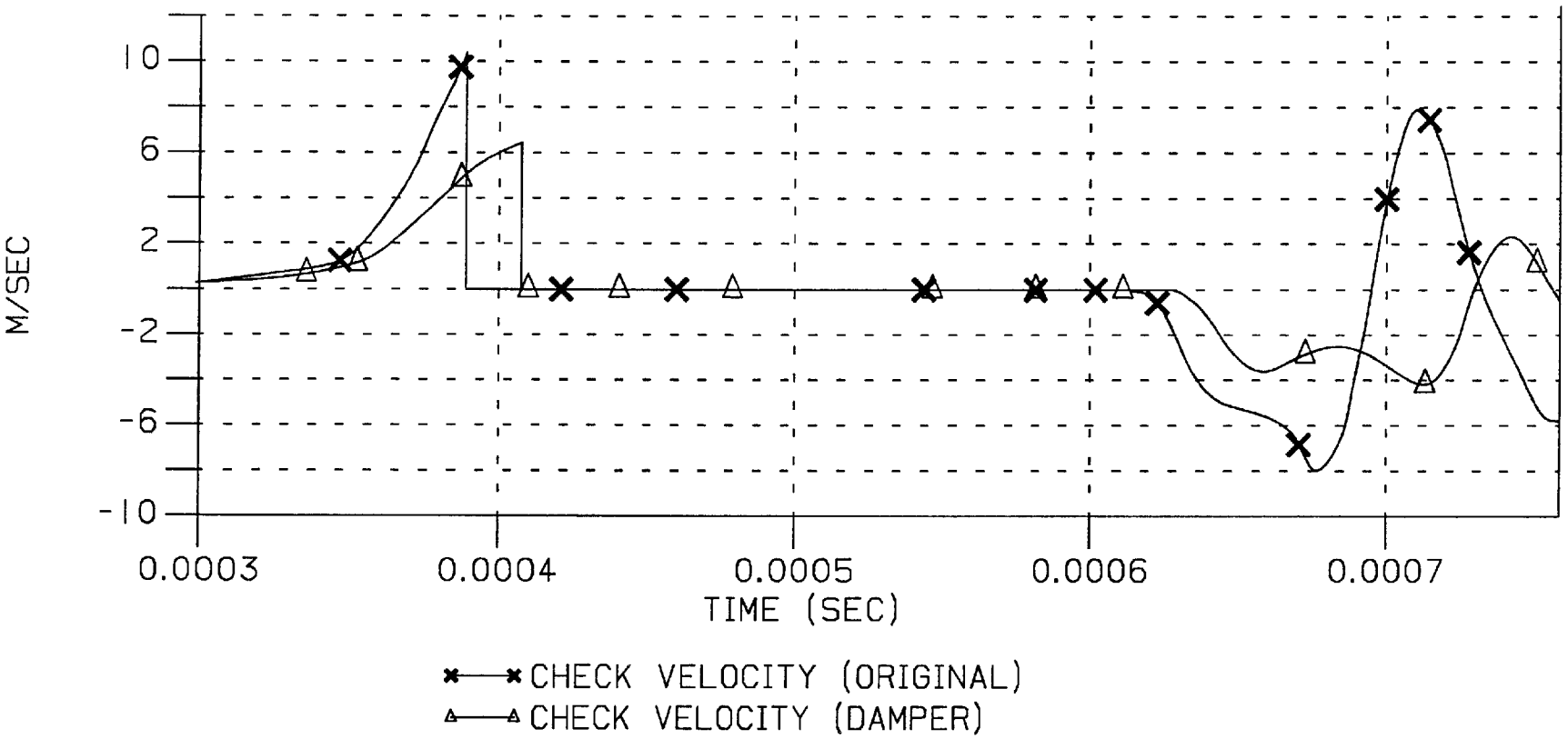
FIG. 4 is a diagrammatic approximate graph of check velocity, V measured in meters/second versus time, T measured in seconds, comparing predicted operation of a computer-simulated exemplary injector of the prior art conventional electronically-controlled injector check valve of FIG. 1 versus the present invention damped injector check valve of FIG. 2.

Referring now to FIG. 3, the close fit hilt 48 and the resultant forces acting on the check, reduce the total impact force over the prior art design by approximately 63%. This is accomplished by reducing the force acting on the check and reducing the check velocity in both the opening and closing directions by approximately 40% over the prior art design, see FIG. 4. As also can be seen from a study of FIG. 4, at the end of injection when the check is moving from the open position to the closed position, the prior art design exhibited a considerable reversal in check velocity which resulted from the check 32 bouncing as it impacted the tip seat 24. In the present invention, the amount of check bounce is reduced as demonstrated by the much lower positive velocity after the initial impact.

Figure 5:
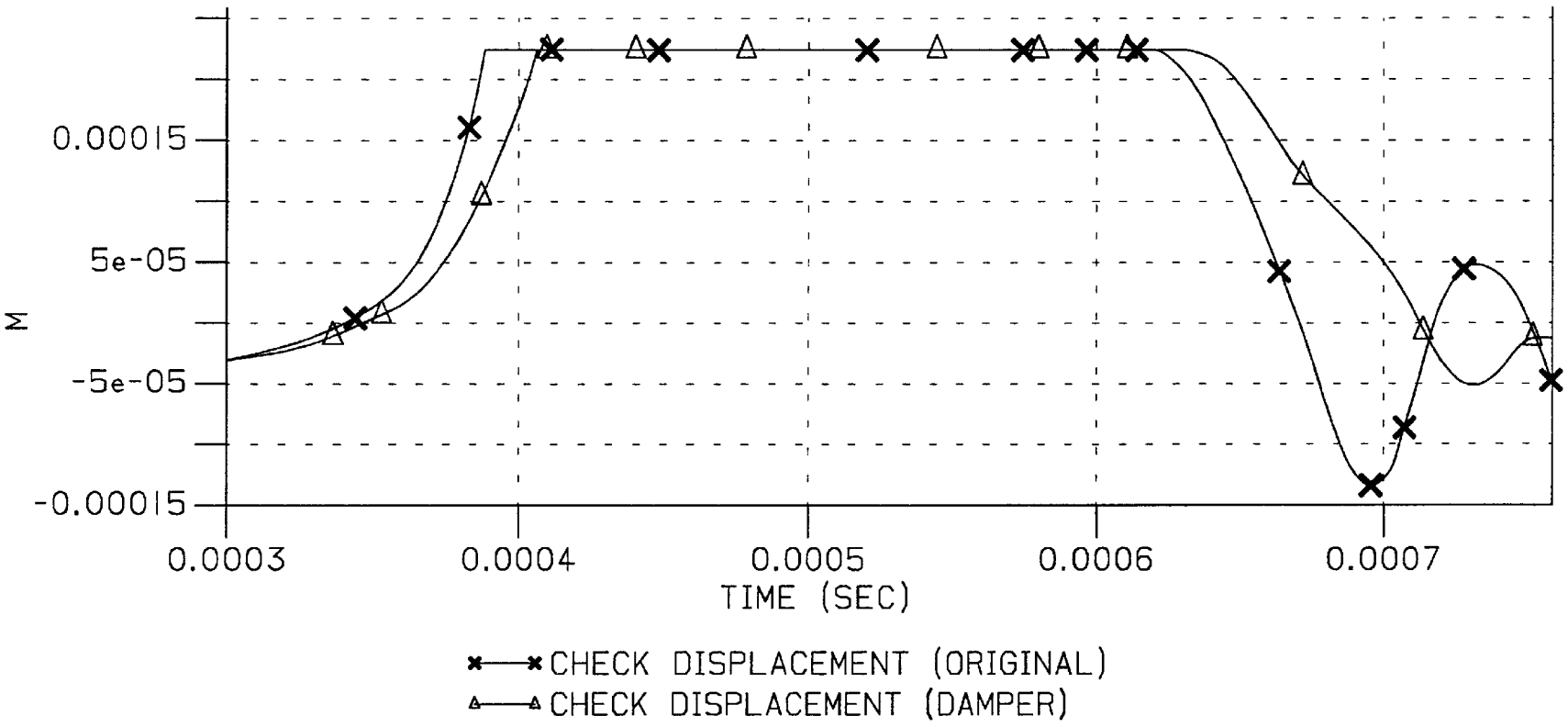
FIG. 5 is a diagrammatic approximate graph of check displacement, D measured in meters versus time, T measured in seconds, comparing predicted operation of a computer-simulated exemplary injector of the prior art conventional electronically-controlled injector check valve of FIG. 1 versus the present invention injector check valve of FIG. 2.

The performance of the fuel injection system 10 is not significantly impacted by the present invention. Referring to FIG. 5, the opening of the check 32 is slowed slightly, approximately 0.02 milliseconds, and the closing slowed by approximately, 0.04 milliseconds. The cut-off of fuel, as it relates to engine emissions, is not significantly impacted by the present invention.

Another benefit of the restriction means 47 is it acts as a restriction to the communication of high pressure fuel to the pressure control chamber 20. The net effect is to slow the rate at which fuel pressure within the pressure control chamber 20 builds and decrease the peak pressure obtained in the pressure control chamber 20. The reduction of the fuel pressure acting on the second effective area of the check 32 reduces the check closing force as the check 32 moves from its open position towards the closed position.

Other aspects, objects, and advantages of this invention can be obtained from a study of the drawings, the disclosure, and the appended claims.

We claim:

1. A fuel injector nozzle including a check stop, a check sleeve, and a nozzle tip defining a pressure control chamber, an injection chamber, at least one injection orifice, a movable direct-operated check disposed within said nozzle tip and being operable to selectively engage a check seat to control fluid communication between the injection chamber and the fuel injection orifice, a pressure control valve to control the movement of said check, the improvement comprising:

the check including an end positioned in said pressure control chamber and a hilt disposed within said injection chamber and being of a construction suitable to divide said injection chamber into a lower hilt chamber and an upper hilt chamber that are different from said pressure control chamber, and said upper hilt chamber being a closed volume above said hilt;

a high pressure fuel passage communicating high pressure fuel to the lower hilt chamber, whereby the stresses on the check seat are lowered when said check engages said check seat; and wherein the pressure within said lower hilt chamber decreases as said check moves from a closed position where said check engeages said check seat towards an open position where said check in spaced apart from said check seat and the pressure within the upper hilt chamber increases as said check moves from said closed position toward said open position.

2. The fuel injector nozzle of claim 1 wherein said hilt is of a diameter sized to tightly reciprocate within said injection chamber.

3. The fuel injector nozzle of claim 1 wherein the pressure within the lower hilt chamber increases as the check moves from said open position towards said closed position and the pressure within the upper hilt chamber decreases as the check moves from said open position towards said closed position whereby the net closing force acting on said check is reduced.

4. The fuel injector nozzle of claim 3 further comprising a first biasing device operable to bias the check towards its closed position.

5. The fuel injector nozzle of claim 4, wherein movement of the check from said open position towards said closed position occurs under the influence of the biasing spring and is resisted by increasing pressure in the lower hilt chamber.

6. A fuel injector comprising;

an injector housing defining a pressure control chamber, an injection chamber, and at least one fuel injection orifice;

injecting means, including a check disposed within said injector housing, for selectively closing and opening fluid communication between the injection chamber and the fuel injection orifice, and said check having one portion positioned in said pressure control chamber and a different portion positioned in said injection chamber;

controlling means disposed within said injector housing for controlling the actuation of said injecting means;

restriction means, including a hilt disposed within said injector housing, for damping the movement of said injecting means, and further including said injector housing and said hilt defining an upper hilt chamber with a closed volume above said hilt and a lower hilt chamber below said hilt; and wherein pressure within said lower hilt chamber decreases as said check moves upward from a closed position towards an open position and pressure within said upper hilt chamber increases as said check moves from said closed position towards said open position.

7. The fuel injector of claim 6, wherein said check is a movable direct-operated check operable to selectively engage a check seat to close and open fluid communication between the injection chamber and the fuel injection orifice.

8. The fuel injector of claim 7, wherein said controlling means includes a pressure control valve selectively movable between a first position and a second position to directly control the movement of said check.

9. The fuel injector of claim 8 wherein said hilt is positioned within said injection chamber and being of a construction for dividing said injection chamber into said lower hilt chamber and said upper hilt chamber.

10. The fuel injector of claim 9 wherein said restriction means further includes a high pressure fuel passage communicating high pressure fuel to the lower hilt chamber, whereby the stresses on the check seat are lowered when said check engages said check seat.

11. The fuel injector nozzle of claim 10 wherein the pressure within the lower hilt chamber increases as the check moves from said open position towards said closed position and the pressure within the upper hilt chamber decreases as the check moves from said open position towards said closed position whereby the net closing force acting on said check is reduced.

12. The fuel injector nozzle of claim 10 wherein the restriction means is of a construction suitable for decelerating the check as the check moves from said open position towards said closed position whereby reducing check bounce.

13. The fuel injector nozzle of claim 10 wherein the restriction means is of a construction suitable for reducing the hydraulic forces acting on said check as said check moves from said open position towards said closed position.

14. A fuel injector comprising:

an injector housing defining a pressure control chamber, a passage, an injection chamber and at least one fuel injection orifice;

a check disposed in said injector housing with one portion positioned in said pressure control chamber and another portion positioned in said injection chamber, and being movable between an open position in which said injection chamber is open to said at least one fuel injection orifice and a closed position in which said injection chamber is closed to said at least one fuel injection orifice;

a control valve disposed in said injector housing and movable between a first position in which said pressure control chamber is open to said passage and a second position in which said pressure control chamber is closed to said passage;

said check including a hilt that divides said injection chamber into an upper hilt chamber and a lower hilt chamber, and said upper hilt chamber being a closed volume above said hilt;

said hilt being sized such that fluid pressure in said lower hilt chamber increases relative to said upper hilt chamber when said check is moving from said open position to said closed position; and said hilt being sized such that fluid pressure in said upper hilt chamber increases relative to said upper hilt chamber when said check is moving from said open position to said open position.

15. The fuel injector of claim 14 wherein said passage opens said injection chamber to said pressure control chamber when said control valve is in said first position.

16. The fuel injector of claim 14 wherein said passage is a first passage;

said injector housing defines a second passage; and said pressure control chamber is closed to said second passage when said control valve is in said first position, and said pressure control chamber is open to said second passage when said control valve is in said second position.

17. The fuel injector of claim 14 further comprising a spring positioned in said injector housing in contact with said hilt of said check.

* * * * *